US005217142A

United States Patent [19]

Schutz

[11] Patent Number: 5,217,142

[45] Date of Patent: Jun. 8, 1993

[54] STACKABLE BUNGHOLE BARREL OF SYNTHETIC RESIN

[76] Inventor: Udo Schutz, Ruckersteg 4, D-5418 Selters, Fed. Rep. of Germany

[21] Appl. No.: 851,896

[22] Filed: Mar. 16, 1992

Related U.S. Application Data

[63] Continuation-in-part of Ser. No. 698,823, May 7, 1991, abandoned.

[30] Foreign Application Priority Data

Mar. 16, 1991 [DE] Fed. Rep. of Germany ..... 4108655
Feb. 6, 1992 [DE] Fed. Rep. of Germany ..... 4203422

[51] Int. Cl.[5] ..... B65D 7/00
[52] U.S. Cl. ..... 220/601; 206/503
[58] Field of Search ..... 220/601; 206/503, 509

[56] References Cited

U.S. PATENT DOCUMENTS 4,674,648 6/1987 Przytucca ..... 220/601
4,736,862 4/1988 Hammes et al. ..... 220/601
4,767,021 8/1988 Pies ..... 220/601
4,776,479 10/1988 Schutz ..... 220/601
4,941,584 7/1990 Bower et al. ..... 220/601
5,014,873 5/1991 Clemens et al. ..... 220/601

*Primary Examiner*—Joseph Man-Fu Moy
*Attorney, Agent, or Firm*—Young & Thompson

[57] ABSTRACT

A filling and discharge bunghole bunghole (9) and an aerating and venting bunghole (10) are arranged in protected fashion in depressions (11, 12) of the lid portion (4) of the bunghole barrel. The stacking surface (8) of the lid portion (4) passes over into two webs (17, 18) extending in the circumferential direction and encompassing the bottom surface of the depression (11) for the filling and discharge bunghole (9), these webs running with a slight slope from the stacking surface (8) toward the bottom surface of the depression (11) and forming, in the slightly tilted upended position (1') of the bunghole barrel, drainage channels (21, 22) for the residual fluid (24) collecting on the inside (27) of the lid portion (4) and flowing off through the bunghole opening (15) of the filling and discharge bunghole (9).

4 Claims, 10 Drawing Sheets

STACKABLE BUNGHOLE BARREL OF SYNTHETIC RESIN

Figure 1:
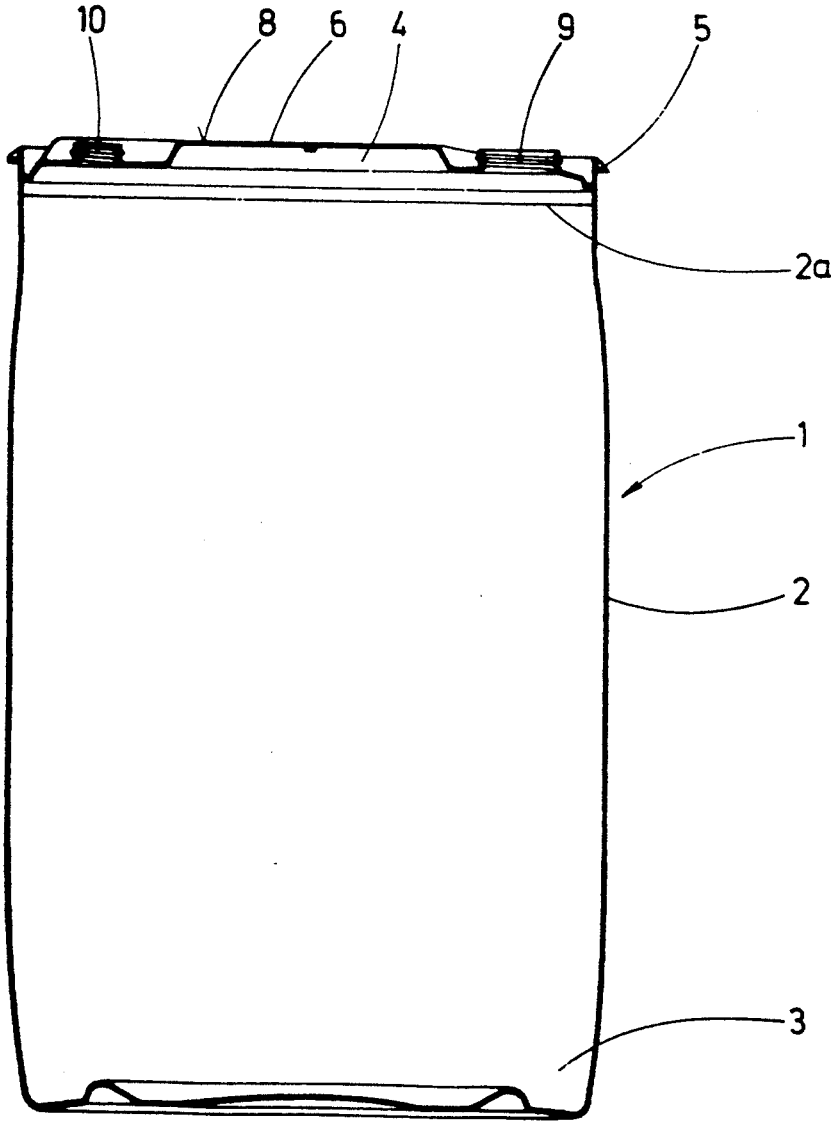

This application is a continuation-in-part of Ser. No. 07/696,823 filed May 7, 1991, now pending now abandoned.

The invention relates to stackable bunghole barrels of a synthetic resin, with a blow-molded side-wall portion, a bottom portion, and a lid portion with a stacking surface, a filling and discharge bunghole, as well as an aerating and venting bunghole, and with a device for residual emptying, wherein the bungholes are hidden in depressions of the lid portion and the depression formed in the lid portion exhibits, for accommodation of the filling and discharge bunghole, a bottom surface with a bunghole opening, this bottom surface being arranged symmetrically to the connecting axis of the diametrically opposed bungholes and being connected, by way of a shoulder, with the stacking surface of the lid portion.

The lid portion of such bunghole barrels according to DE 9,001,802 U1 comprises an inclined surface having the shape of a circular segment and being oriented inwardly into the barrel body, this inclined surface having its lowest point on the side of the barrel sidewall, terminating flush into the hidden bottom surface of the aerating and venting bunghole, and being divided into two area sections by the bottom surface of the bunghole. For purposes of residual emptying, the barrel is tilted from the upended position by an angle of 20° so that the residual fluid collecting on the inside of the lid portion can be discharged via the two area sections of the inclined surface into the thus-formed dish between the barrel sidewall and the inclined surface behind the bunghole and, from there, through the bunghole opening.

In daily operation, these conventional bunghole barrels, during residual emptying, often are not tilted vigorously enough from the upended position into the inclined position of at least 20° required for complete emptying of residues so that residual amounts of liquid still remain in the barrels.

The invention is based on the object of developing a bunghole barrel permitting complete residual emptying in the upended position even with a slight oblique positioning.

This object has been attained according to the invention by a bunghole barrel having the features of claim 1.

The dependent claims are directed to advantageous further developments of the invention.

The bunghole barrel according to the invention is distinguished by attaining the posed object in a simple and expedient fashion.

Figure 3:
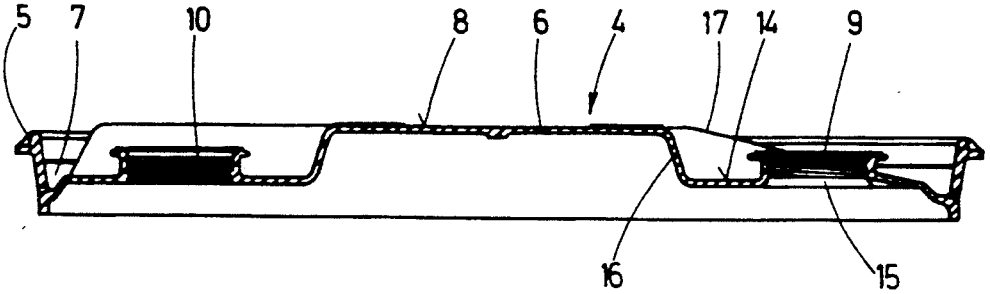
Figure 2:
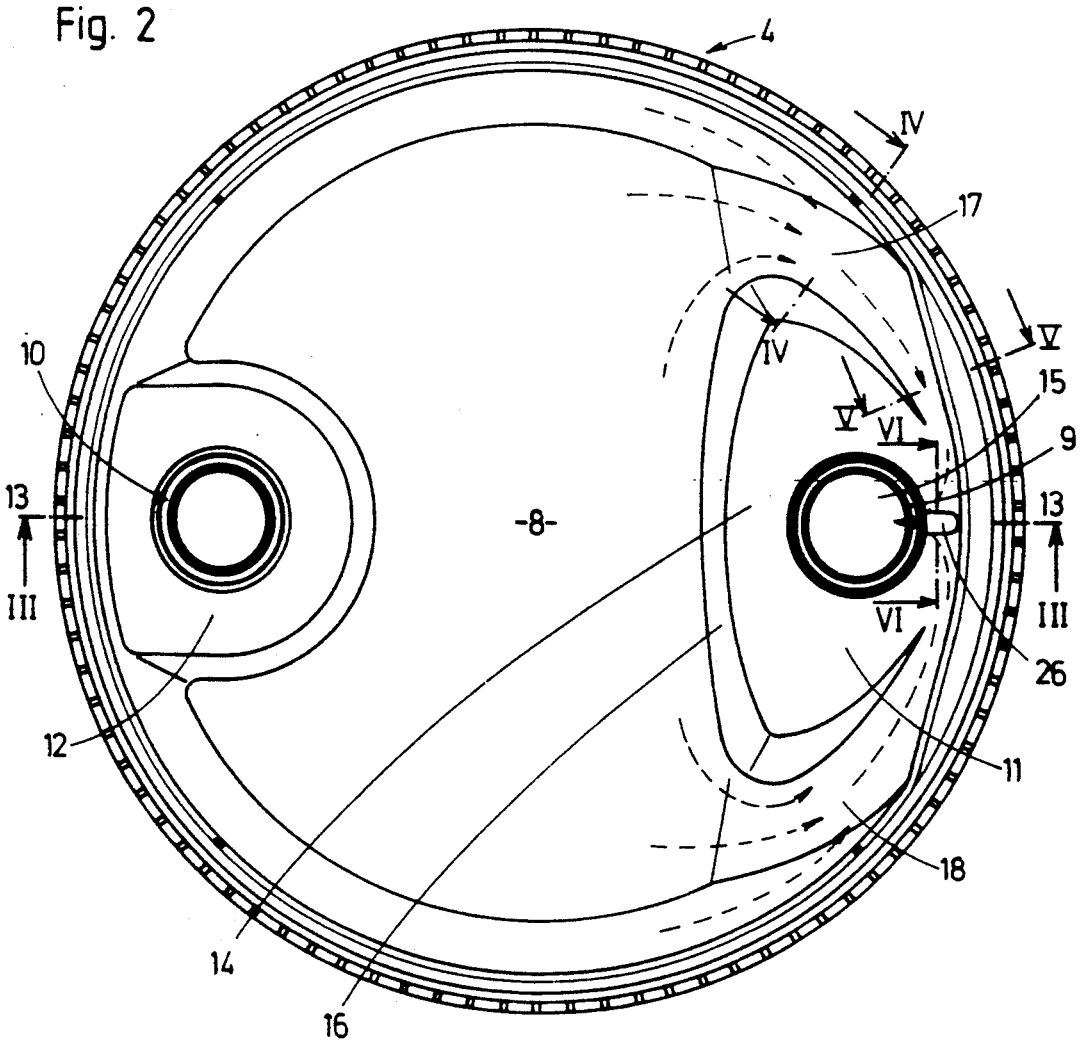
Figure 4:
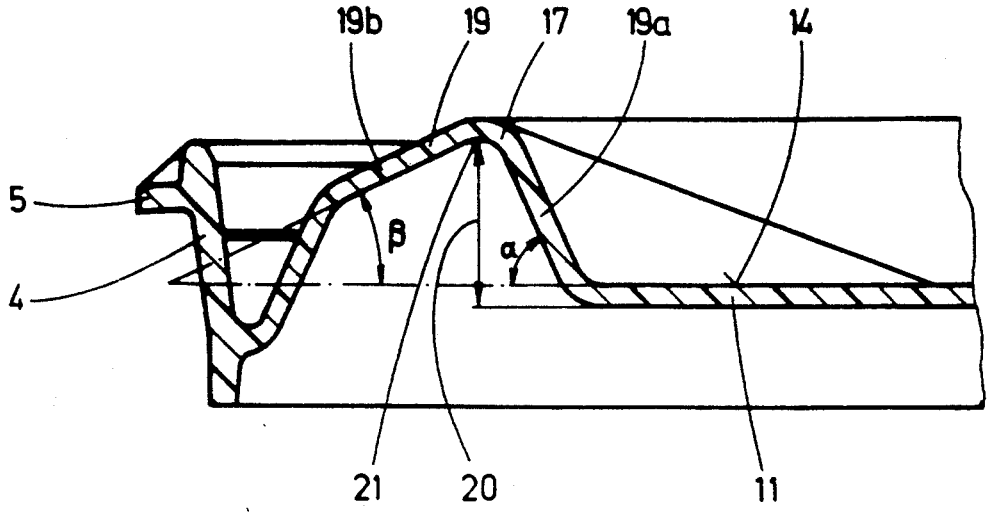
Figure 5:
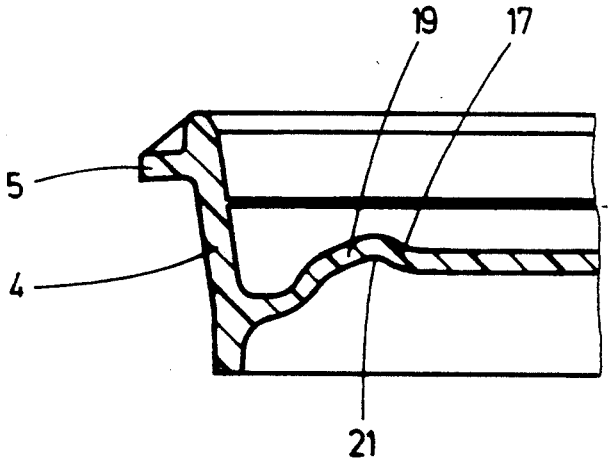
Figure 6:
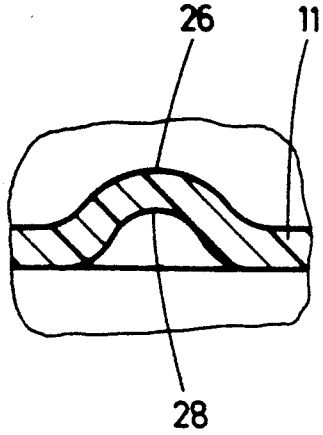
Figure 7:
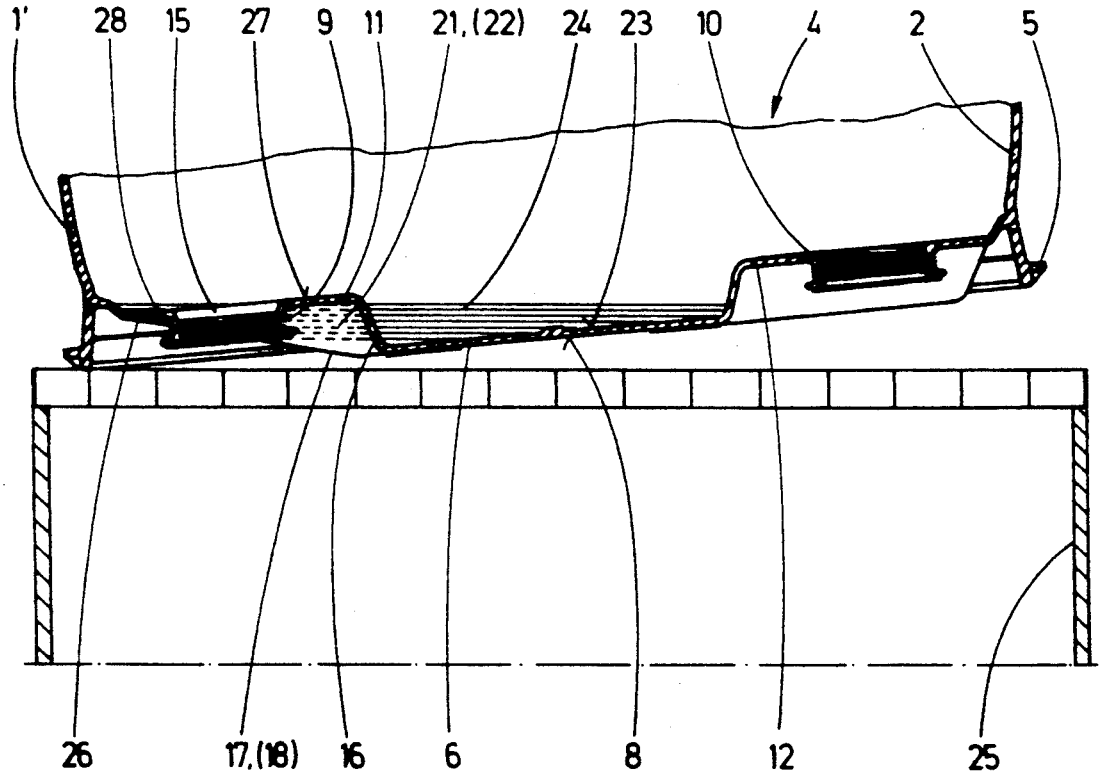
Figure 8:
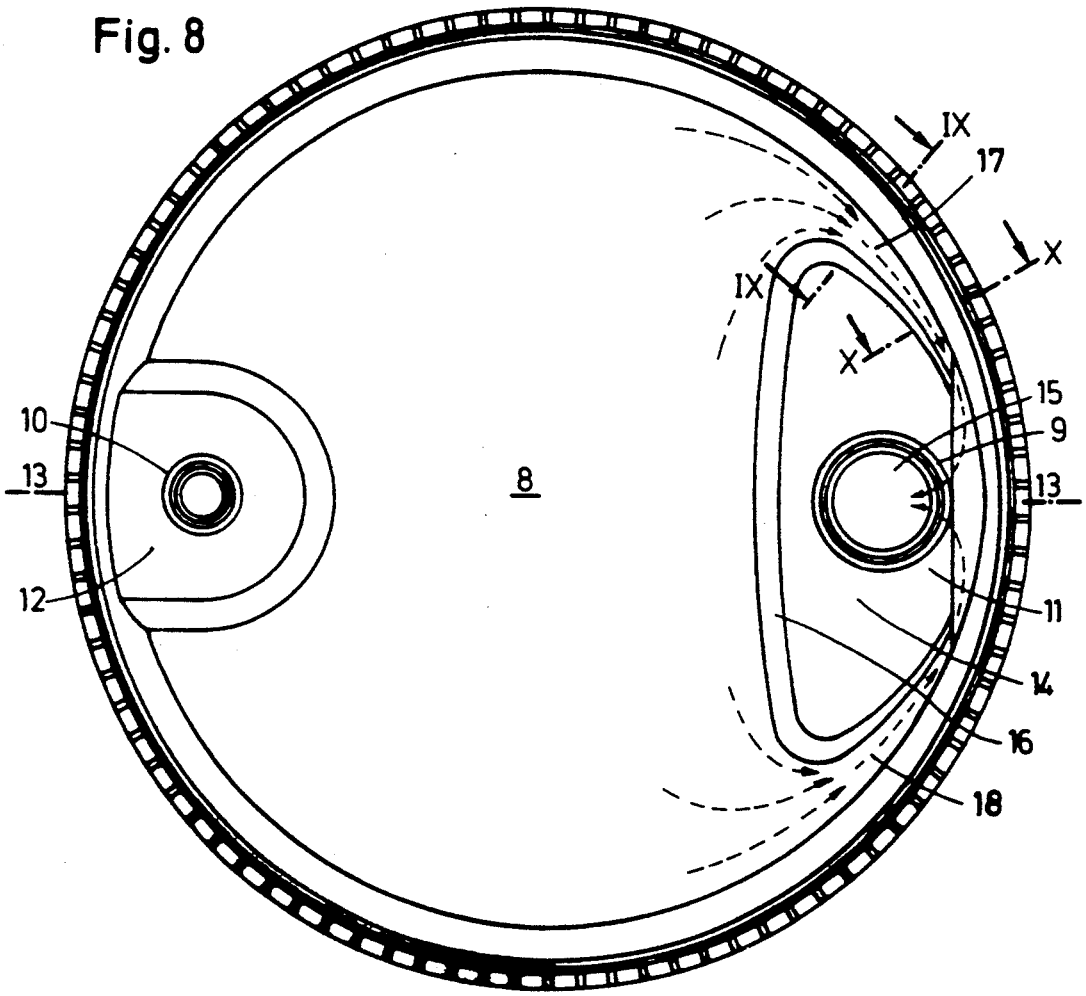
Figure 9:
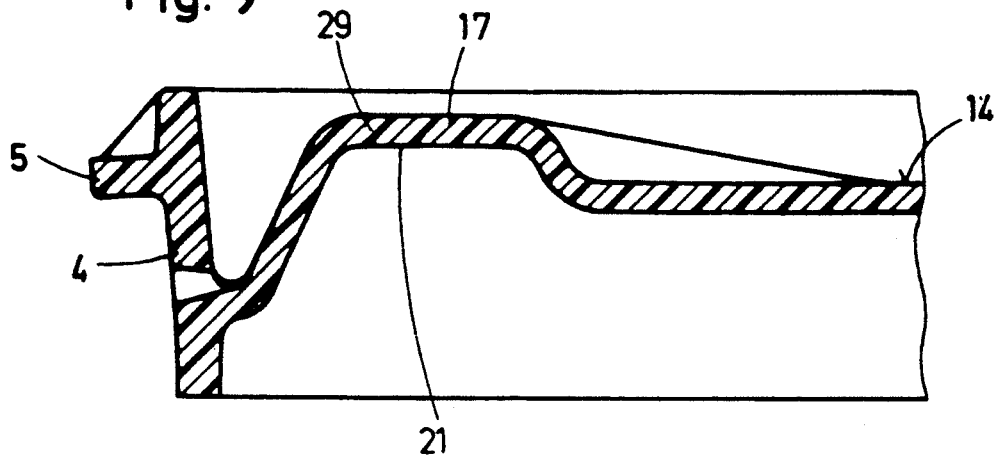
Figure 10:
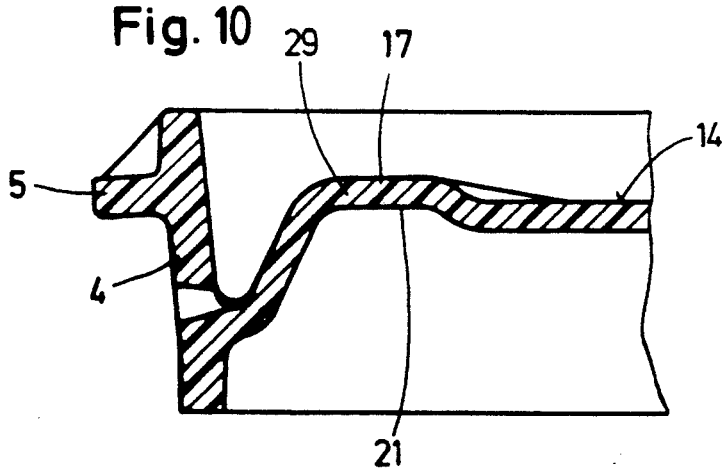
Figure 11:
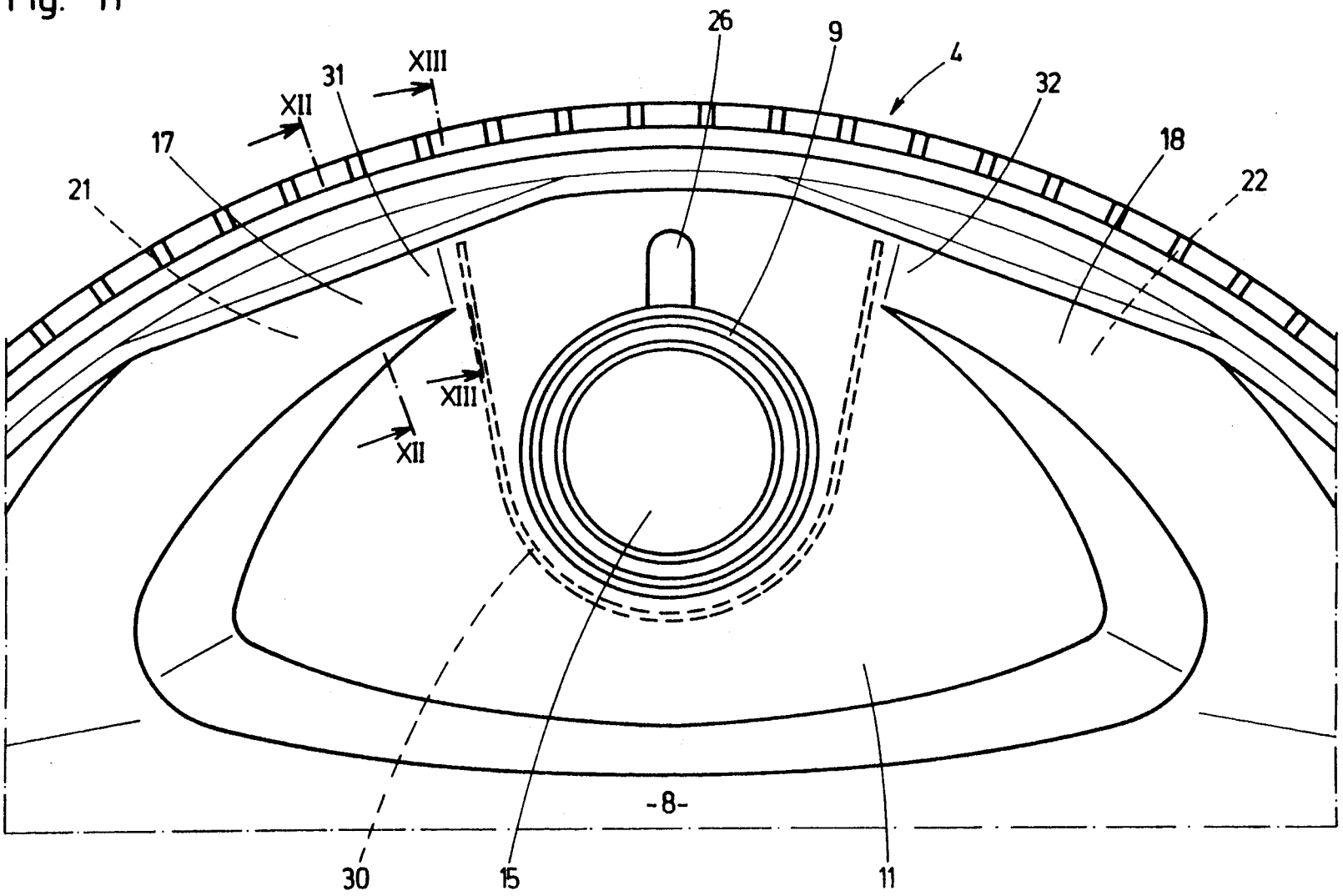
Figure 12:
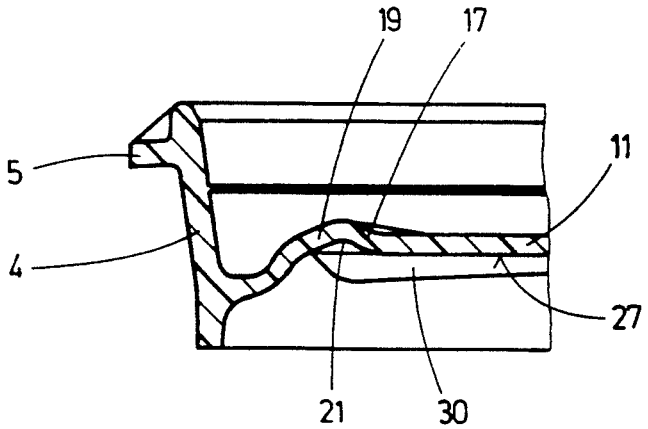
Figure 13:
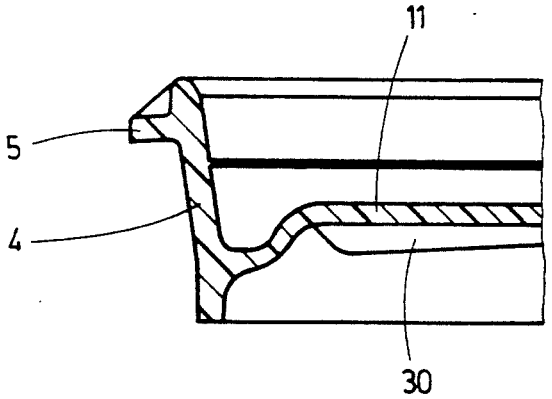
Figure 14:
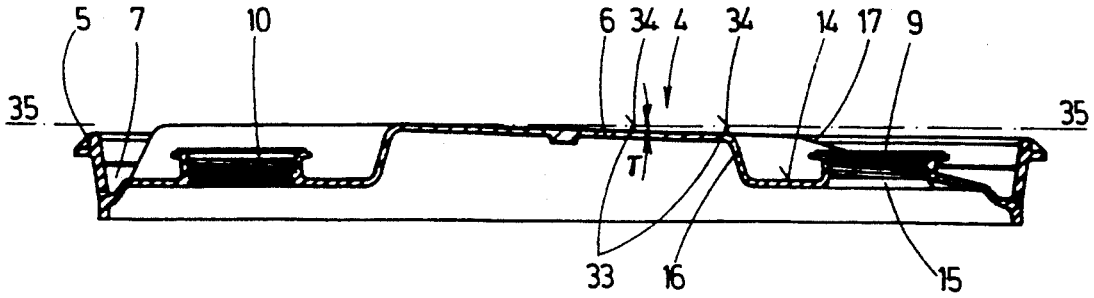
Figure 15:
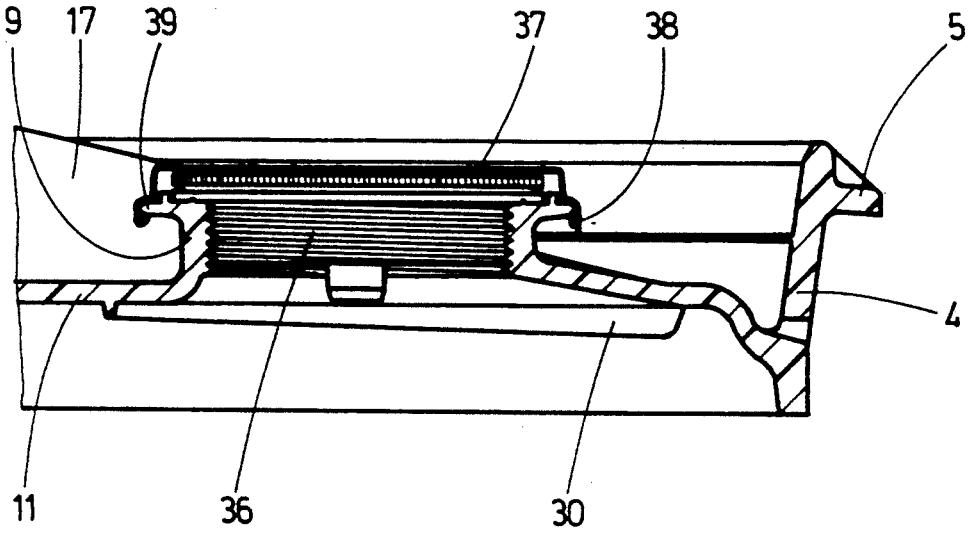
Figure 16:
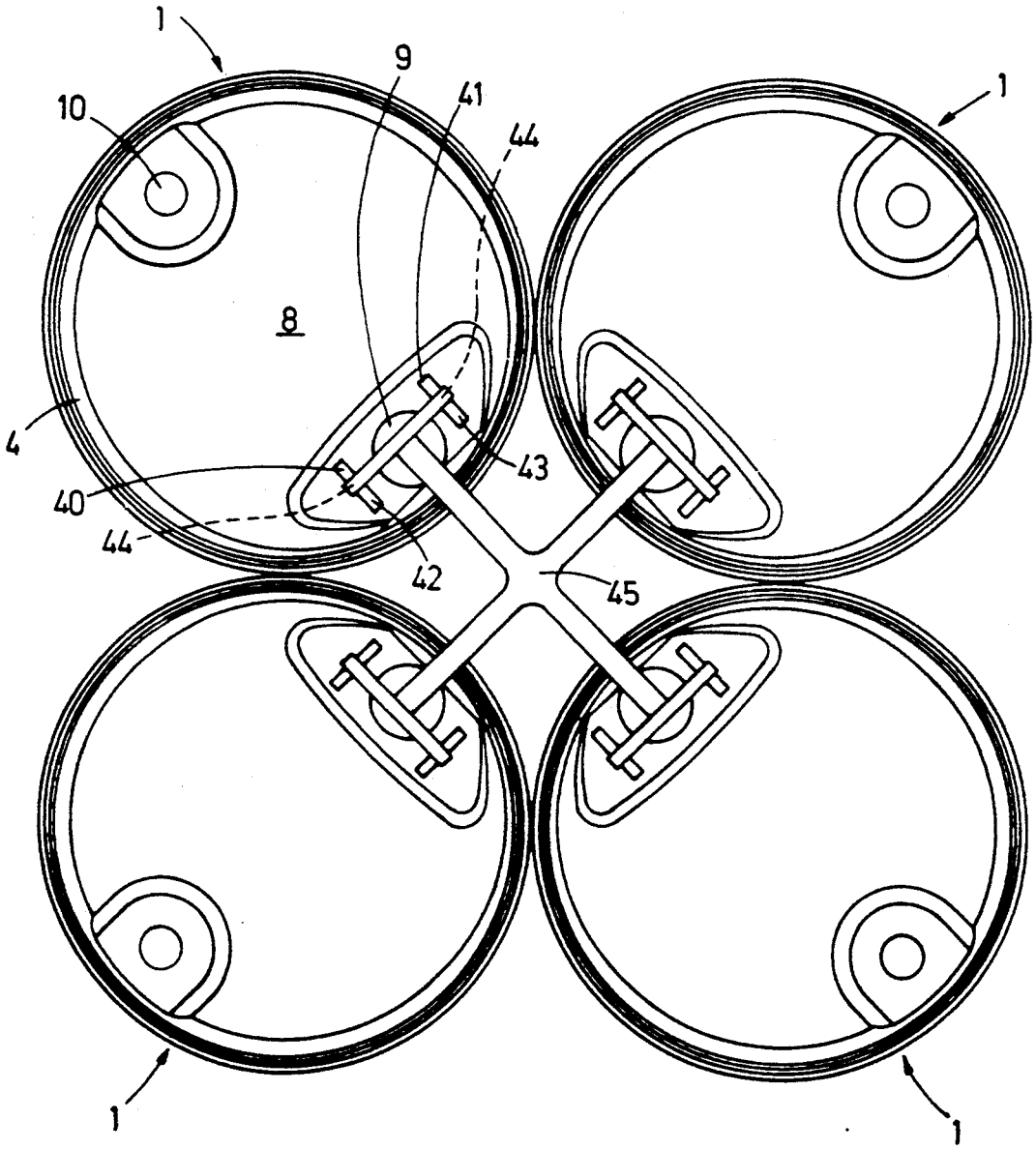

The invention will be described in greater detail below with reference to several embodiments illustrated in the drawings wherein:

FIG. 1 is a longitudinal sectional view of the bunghole barrel according to the invention, FIG. 2 is a top view of the barrel according to FIG. 1, FIG. 3 is a longitudinal section through the lid portion of the bunghole barrel along line III—III of FIG. 2, FIGS. 4–6 show enlarged partial sectional views of the lid portion along lines IV—IV, V—V and VI—VI of FIG. 2, FIG. 7 shows the lid portion in a longitudinal sectional view in the residual emptying position of the bunghole barrel, FIG. 8 shows a top view of a bunghole barrel with a modified design of the lid portion, FIGS. 9 and 10 show enlarged partial sectional views of the lid portion along lines IX—IX and X—X of FIG. 8, FIG. 11 shows a fragmentary enlarged top view of a bunghole barrel with another embodiment of the lid portion, FIGS. 12 and 13 show enlarged partial sectional views of the lid portion along lines XII—XII and XIII—XIII of FIG. 11, FIG. 14 shows a longitudinal sectional view of another modified lid portion, FIG. 15 shows a longitudinal section through the filling and discharge bunghole of the various lid portions, sealed with a screw plug and with a safety and sealing cap, in an enlarged representation, and FIG. 16 shows a top view of four combined bunghole barrels with a further embodiment of the lid portion.

The bunghole barrel 1, manufactured of a synthetic resin, consists of a sidewall portion 2, a bottom portion 3, and a lid portion 4 wherein the lid portion 4 is produced as an injection-molded plastic part whereas the sidewall portion 2 and the bottom portion 3 are produced by extrusion blow-molding. The lid portion 4, welded to the sidewall portion 2 over the circumference at 2*a*, exhibits a supporting and roller chime 5 adjoined by the lid bottom 6; an annular groove 7 extends continuously between this lid bottom and the supporting and roller chime 5. The lid bottom 6 forms a stacking surface 8 projecting in the direction of the longitudinal barrel axis past the supporting and roller chime 5.

A filling and discharge bunghole 9 and an aerating and venting bunghole 10 are integrally molded to the lid portion 4; these bungholes are arranged in diametrical opposition hidden in depressions 11, 12 of the lid portion 4 and are closed by means of screw plugs, not shown.

The depression 11 in the lid portion 4 for accommodating the filling and discharge bunghole 9 has a bottom surface 14 with a bunghole opening 15, this bottom surface being located symmetrically to the connecting axis 13—13 of the diametrically opposite bungholes 9, 10 and being connected, by way of a shoulder 16, with the stacking surface 8 of the lid portion 4.

The stacking surface 8 passes over into two ramp-like webs 17, 18 extending in the circumferential direction of the lid portion 4 and encompassing the bottom surface 14 of the depression 11 for the filling and discharge bunghole 9; these webs extend with a slight gradient from the stacking surface 8 of the lid portion 4 to the bottom surface 14 of the depression 11. The webs 17, 18 exhibit a reversed, asymmetrical, V-shaped cross-sectional profile 19 with a height 20 decreasing in correspondence with their gradient from the stacking surface 8 of the lid portion 4 toward the bottom surface 14 of the depression 11 for the filling and discharge bunghole 9. The V-shaped cross-sectional profile 19 of the webs 17, 18 is characterized by legs 19*a*, 19*b* of different lengths and with differing angles of inclination $\alpha$, $\beta$ with respect to the bottom surface 14 of the depression 11 for the filling and discharge bunghole 9.

In the slightly tilted upended position 1' of the bunghole barrel 1 according to FIG. 7, the webs 17, 18 of the lid portion 4 form drainage ducts 21, 22 for the residual fluid 24 collecting on the inside 23 of the lid portion 4, this fluid running along the inner wall of the lid portion 4 and being drained through the bunghole opening 15 of the filling and discharge bunghole 9 into a collecting tank 25.

A rib-like elevation 26 is located on the connecting axis 13—13 between the two bungholes 9, 10, leading in slightly ascending fashion from the annular groove 7 between the supporting and roller chime 5 and the bottom 6 of the lid portion 4 to the base of the filling and discharge bunghole 9; in the upended position 1' of the bunghole barrel 1, this elevation forms, on the inside 27 of the depression 11 accommodating the filling and discharge bunghole 9, a drainage channel 28 extending with a slight gradient toward the filling and discharge bunghole 9, ensuring that the residual fluid 24 runs off completely from the lid portion 4 into the collecting tank 25.

In the bunghole barrel arrangement according to FIGS. 8 through 10, the ramp-like webs 17, 18 of the lid portion 4 exhibit a trapezoidal profile 29 for the formation of the drainage channels 21, 22 in the upended position 1' of the barrel 1; this profile is flattened, in correspondence with the gradient of the drainage channels 21, 22, from the stacking surface 8 of the lid portion 4 toward the bottom surface 14 of the depression 11 for the filling and discharge bunghole 9.

The bunghole barrel according to FIGS. 11-13 is characterized in that a barrier 30 extending arcuately around the bunghole 15 is integrally formed on the inside 27 of the depression 11 of the lid portion 4 accommodating the filling and discharge bunghole 9; this barrier is extended into the zone of the terminations 31, 32 of the drainage channels 21, 22 into the depression 11 for the filling and discharge bunghole 9 and forms a collecting dish for the residual fluid 24 in the tilted upended position 1' of the barrel 1. The barrier 30 slightly ascends from the filling and discharge bunghole 9 toward the drainage channels 21, 22. The collecting dish formed by the barrier 30 prevents the residual fluid 24 from running back through the drainage channels 21, 22 into the lid portion 4 when the barrel 1 is tipped back from the tilted upended position 1' into the vertical upended position. Thus, it is ensured that, with a one-time or optionally also twice tilting of the barrel 1 from the totally upended position into the tilted upended position 1', the collected residual fluid 24 is completely discharged form the lid section 4 through the bunghole opening 15 of the filling and discharge bunghole 9.

In order to enhance the emptying process, the lid portion 4 can be fashioned, according to FIG. 14, in such a way that the bottom 6 of the lid portion 4 extends with a slight slope of approximately 3° from the aerating and venting bunghole 10 toward the filling and discharge bunghole 9. In this lid design, supporting ridges 33 for a stacked barrel are molded on the outside to the bottom 6 of the lid portion 4, the supporting edges 34 of these ridges lying in the stacking plane 35—35 extending perpendicularly to the barrel sidewall 2.

The filling and discharge bunghole 9 and the aerating and venting bunghole 10 of the lid portion 4 of the bunghole barrel 1 are closed by screw plugs 36 of a synthetic resin (FIG. 15). Additionally, safety and sealing caps 37 of sheet metal or plastic, with an inserted sealing ring 38, are placed on the bungholes 9, 10; these caps are clinched to the bunghole flange 39.

In the bunghole barrel embodiment of FIG. 16, the bunghole barrels 1 are equipped with lid portions 4 wherein the filling and discharge bunghole 9 is surrounded, at a spacing, by supporting and protective ridges 40, 41, the supporting edges 42, 43 of which lie in the plane of the stacking surface 8. The supporting and protective ridges 40, 41 are equipped with openings 44 for suspending therein a cross yoke 45, with the aid of which respectively four bunghole barrels 1 can be linked together for empty transport. The transporting of the barrels in the empty state is considerably facilitated by this conveying aid.

What is claimed is:

1. In a stackable bunghole barrel of a synthetic resin, with a blow-molded sidewall portion, a bottom portion, and a lid portion with a stacking surface, a filling and discharge bunghole, as well as an aerating and venting bunghole, and a device for residual emptying, wherein the bungholes are hidden in depressions of the lid portion and the depression formed in the lid portion exhibits, for accommodation of the filling and discharge bunghole, a bottom surface with a bunghole opening, this surface being arranged symmetrically to the connecting axis of the diametrically opposed bungholes and being connected, by way of a shoulder, with the stacking surface of the lid portion, wherein the stacking surface (8) passes over into two ramp-like webs (17, 18) extending in the marginal zone and in the circumferential direction of the injection-molded lid portion (4) and encompassing the bottom surface (14) of the depression (11) for the filling and discharge bunghole (9), these webs extending with a slight gradient from the stacking surface (8) of the lid portion (4) toward the bottom surface (14) of the depression (11) for the filling and discharge bunghole (9) and forming, in the slightly tilted upended position (1') of the bunghole barrel (1), drainage channels (21, 22) for the residual fluid (24) collecting on the inside (23) of the lid portion (4) and flowing out through the bunghole opening (15) of the filling and discharge bunghole (9), the ramp-like webs (17, 18) of the lid portion (4) having, for the formation of drainage channels (21, 22) in the upended position (1') of the bunghole barrel (1), a reverse V-shaped cross-sectional profile (19) with a height (20) which decreases in correspondence with their gradient from the stacking surface (8) of the lid portion (4) toward the bottom surface (14) of the depression (11) for the filling and discharge bunghole (9); the improvement wherein the webs (17, 18) have an asymmetrical, V-shaped cross-sectional profile (19) the differently long legs (19*a*, 19*b*) of which have different acute angles of inclination ($\alpha$, $\beta$) with respect to the bottom surface (14) of the depression (11) for the filling and discharge bunghole (9).

2. Bunghole barrel according to claim 1, characterized in that the webs (17, 18) of the lid portion (4) which from the drainage channels (21, 22) exhibit a gradient of 6°-14°.

3. Bunghole barrel according to claim 1, characterized by a rib-like elevation (26) arranged on the connecting axis (13—13) between the two bungholes (9, 10), this elevation extending from the annular groove (7) between the supporting and roller chime (5) and the bottom (6) of the lid portion (4) to the filling and discharge bunghole (9) and forming, on the inside (27) of the depression (11) accommodating the filling and discharge bunghole (9), in the upended position (1') of the barrel (1), a drainage channel (28) leading into the filling and discharge bunghole (9).

4. Bunghole barrel according to claim 3, characterized in that the rib-like elevation (26) slightly ascends from the annular groove (7) toward the base of the filling and discharge bunghole (9) in such a way that the drainage channel (28), in the upended position (1') of the barrel (1), extends with a slight slope toward the filling and discharge bunghole (9).

* * * * *